US005722790A

United States Patent [19]

Spray

[11] Patent Number: 5,722,790

[45] Date of Patent: Mar. 3, 1998

[54] ASPHALT PAVING MACHINE HAVING WEIR ASSEMBLY FOR MINIMIZING SEGREGATION OF HOT MIX ASPHALT

[75] Inventor: Orville Oren Spray, Great Bend, Kans.

[73] Assignee: Venture Corporation, Great Bend, Kans.

[21] Appl. No.: 579,229

[22] Filed: Dec. 28, 1995

[51] Int. Cl.[6] ..... E01C 19/18

[52] U.S. Cl. ..... 404/108; 404/110

[58] Field of Search ..... 404/92, 101, 108, 404/110

[56] References Cited

U.S. PATENT DOCUMENTS

| | | | |
|---|---|---|---|
| 3,398,662 | 8/1968 | Takata et al. | 404/108 X |
| 3,608,446 | 9/1971 | Plant . | |
| 3,904,723 | 9/1975 | Prince . | |
| 3,967,912 | 7/1976 | Parker . | |
| 3,997,277 | 12/1976 | Swisher, Jr. et al. . | |
| 4,012,160 | 3/1977 | Parker . | |
| 4,256,414 | 3/1981 | Milligan . | |
| 4,591,275 | 5/1986 | Garthus . | |
| 5,002,426 | 3/1991 | Brown et al. . | |
| 5,533,829 | 7/1996 | Campbell | 404/110 X |

*Primary Examiner*—James Lisehora

*Attorney, Agent, or Firm*—Hovey, Williams, Timmons & Collins

[57] ABSTRACT

An asphalt paving machine has spreading mechanism for distributing paving material to the roadway, a hopper, a conveyor forming the bottom of the hopper for moving paving material along a path extending through the hopper and to the spreading mechanism, and a device for mixing the paving material as it moves along the path. The mixing device includes at least one stationary weir member mounted within the hopper and spaced above the conveyor. The weir member is positioned in the path of the paving material and presents an upright surface having a bottom edge. The bottom edge of the weir member and the conveyor define a generally vertical passageway through which the paving material passes as it is moved by the conveyor.

9 Claims, 2 Drawing Sheets

P
P'
72
20
66
72a
64
50
58
56
54
16
46e
46c
46d
42
40
34
44e
44a
44b
44c
44d
44
70
48
18
68
72b

ASPHALT PAVING MACHINE HAVING WEIR ASSEMBLY FOR MINIMIZING SEGREGATION OF HOT MIX ASPHALT

BACKGROUND OF THE INVENTION

1. Field of the Invention

The present invention relates generally to asphalt paving machines and, more particularly, to a device disposed within the hopper of the machine for mixing paving material as a conveyor moves the material along a path extending through the hopper.

2. Discussion of Prior Art

Although hot mix asphalt is widely used as a paving material, it is somewhat problematic in that the mixture tends to segregate into coarse material and fine material, commonly referred to as segregation. Typically, hot mix asphalt is relatively homogeneous immediately after preparation. However, a majority of paving sites are remotely located from the place of preparation, which requires transporting the asphalt to the site. Transportation usually involves loading a dump truck with the mixture and driving the distance between the paving site and asphalt preparation location. The vibrations and jostling associated with vehicle transport tends to separate the hot mix asphalt into coarse material and fine material. Of course, it is also possible that the hot mix asphalt was never sufficiently mixed and therefore not homogenized during preparation. Moreover, this problem has been magnified in the recent past, as the prescribed concentration of rock filler in asphalt mixtures has steadily increased.

As those skilled in the art will appreciate, conventional paving machines do not eliminate the problem of segregation. Such machines traditionally include a hopper into which the mixture is dumped from the vehicle, and a pair of fore-and-aft conveyors forming the bottom of the hopper and moving mixture rearwardly along the length of the machine to a laterally extending trough. A pair of augers are disposed within the trough for spreading the hot mix asphalt forward of a finishing screed which serves to press and level the hot mix asphalt. However, even the relatively extensive manipulation of the mixture by the paving machine does not eliminate segregation of the mixture prior to placement upon the road surface. If a segregated mixture is utilized to pave the roadway, the resulting pavement exhibits poor structural and textual characteristics and has a shorter life expectancy.

Various mixing devices for minimizing segregation have been developed, however, it is necessary that the mixing device be proximal to the paving machine, so that the device alleviates segregation caused during transportation of the hot mix asphalt. It is also known to provide a rotating paddle mixer within the hopper adjacent the conveyors for mixing the asphalt mixture as it is moved by the conveyors. The paddle mixer requires a drive mechanism for selectively rotating the former. However, relatively complex structure must be included for rotatably mounting the mixer to the machine and drivingly connecting the mixer to the drive mechanism. Moreover, hot mix asphalt is inherently viscid and tends to adhere to the various components of the paddle mixer, adversely affecting operation thereof.

OBJECTS AND SUMMARY OF THE INVENTION

Responsive to these problems, an object of the present invention is to provide a device for minimizing segregation of hot mix asphalt. Another object of the present invention is to provide a device for minimizing segregation that is positioned proximal to the paving machine, so that segregation caused during transportation of the asphalt mixture is reduced. Yet another object of the present invention is to provide a conventional paving machine with a device that is effective in minimizing segregation, while simple in construction. Moreover, an object of the present invention is to position a stationary asphalt mixing device in the hopper of the paving machine that serves to mix the asphalt mixture and thereby minimize segregation as the mixture is moved by the conveyor.

In accordance with these and other objects evident from the following description of a preferred embodiment of the invention, the asphalt paving machine includes spreading mechanism for distributing paving material to the roadway, a hopper, a conveyor forming the bottom of the hopper for moving paving material along a path extending through the hopper and to the spreading mechanism, and a device for mixing the paving material as it moves along the path. The device includes at least one stationary weir member mounted within the hopper of the paving machine and spaced above the conveyor. The weir member is positioned in the path of the paving material and presents an upright surface having a bottom edge, which defines a generally vertical passageway through which the paving material passes as it is moved by the conveyor.

Preferably, the device includes a plurality of weir members spaced along the path of the paving material. Furthermore, the passageways have incrementally increasing heights along the path of movement of the paving material. The preferred weir members are formed of rectangular, metal plates extending transversely to the path of the paving material, wherein the bottom edges of the plates are substantially parallel to the conveyor.

BRIEF DESCRIPTION OF THE DRAWING FIGURES

A preferred embodiment of the invention is described in detail below with reference to the attached drawing figures, wherein.

Figures 2, 3, 4, 5, 6:
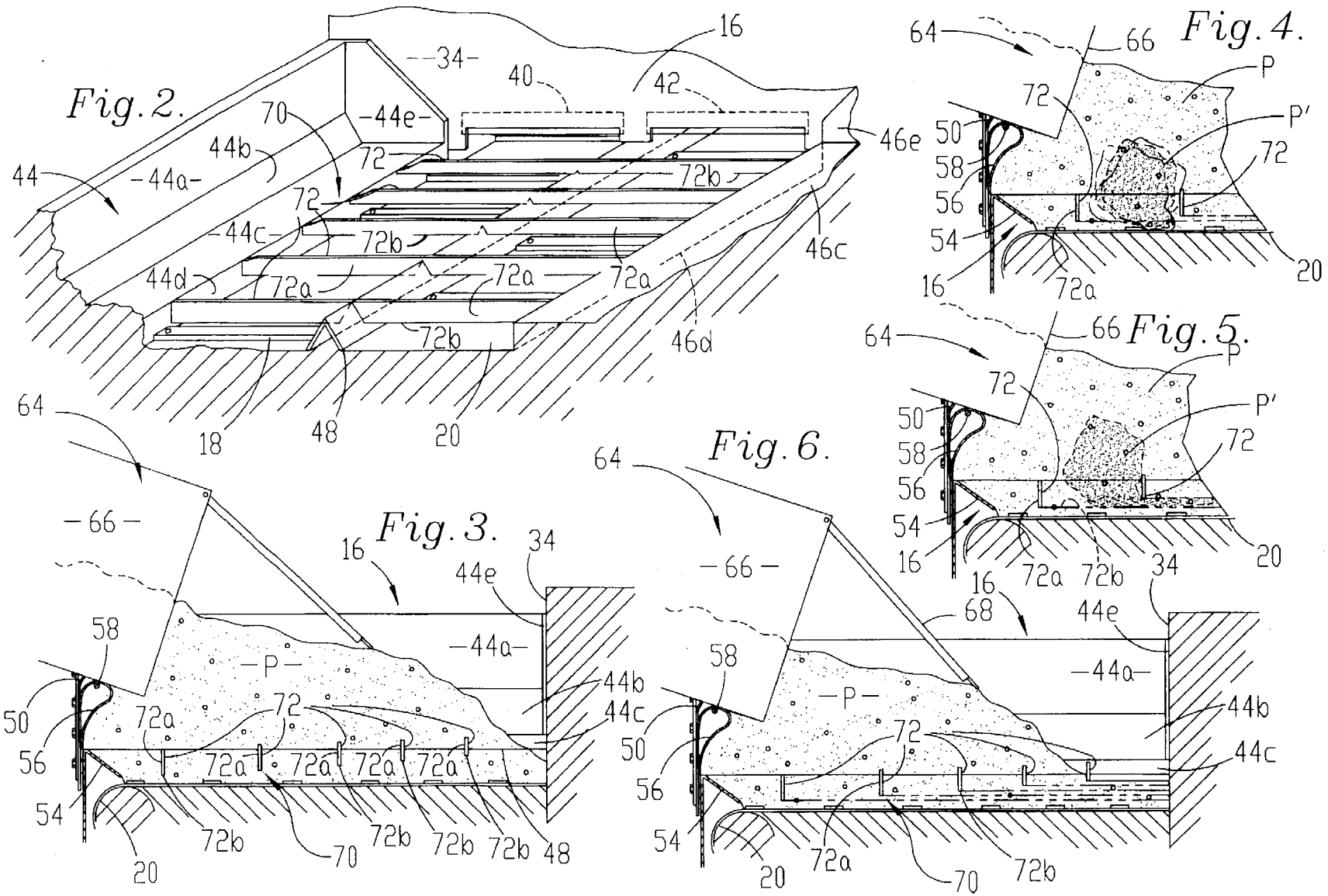
FIG. 2 is an enlarged, fragmentary, perspective view of the hopper of the paving machine having the preferred weir assembly mounted therein, particularly illustrating the spacing and vertical positioning of the weir members.
FIG. 3 is a fragmentary, vertical cross-sectional view taken within the hopper illustrated in FIG. 2, with the bed of a dump track slightly raised and connected to the hopper, as material dumps from the truck bed to the hopper.
FIG. 4 is a fragmentary, vertical cross-sectional view of the front section of the hopper illustrated in FIG. 3, particularly illustrating a mass of segregated material, which tumbles and shakes as a result of transfer by the conveyors and operating vibrations of the machine.

FIG. 5 is a fragmentary, vertical cross-sectional view similar to FIG. 4, particularly illustrating the mass of segregated material with a lower portion thereof being sheared off by the conveyors; and FIG. 6 is a fragmentary, vertical cross-sectional view similar to FIG. 3, particularly illustrating the vertical passageways defined between the bottom edge of each weir member and the conveyors and the amount of paving material allowed to flow therethrough.

DETAILED DESCRIPTION OF THE PREFERRED EMBODIMENT

Figure 1:
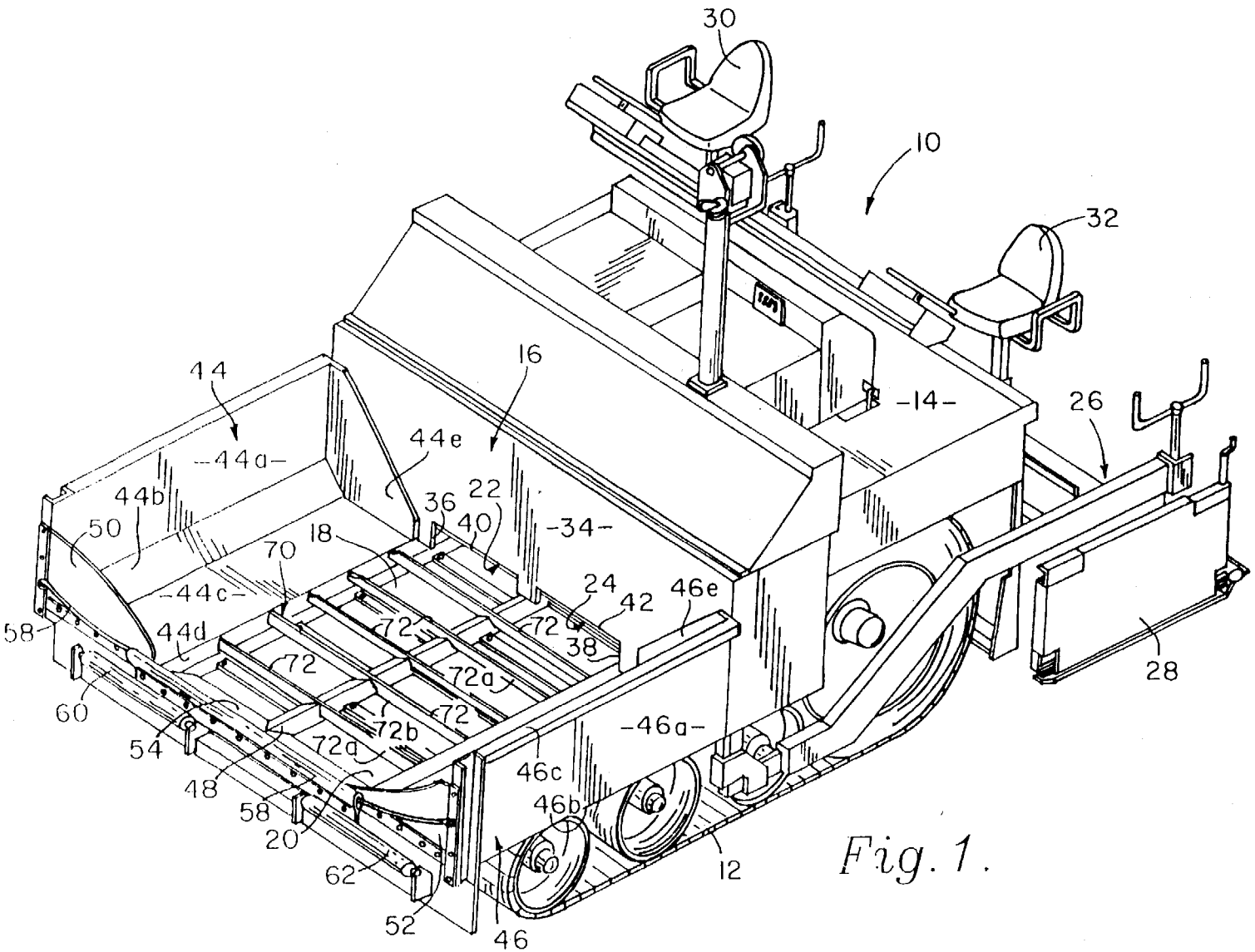
FIG. 1 is a perspective view of an asphalt paving machine having a mixing device constructed in accordance with the preferred embodiment of the invention.

Turning now to the drawings, and particularly FIG. 1, the asphalt paving machine 10 selected for illustration in connection with the mixing device of the present invention has endless drive tracks 12 for moving the machine 10 along the roadway. The tracks are powered by a combustion engine (not shown) housed within an engine compartment 14. A hopper 16 is positioned forwardly of the engine compartment 14, and is configured for receiving paving material from a dump truck or the like. A pair of endless, fore-and-aft extending, slatted conveyors 18,20 form the bottom of the hopper 16. The conveyors 18 and 20 serve to move the paving material rearwardly (rightwardly viewing FIGS. 3 and 6) through the hopper 16, through a pair of tunnels 22 and 24 defined in the engine compartment 14, and to a spreading mechanism, generally denoted by the numeral 26, that distributes the paving material to the roadway. Accordingly, the conveyors 18,20 move the asphalt mixture along a fore-and-aft path that extends through the hopper 16, the engine compartment 14 and to the spreading mechanism 26.

As those of ordinary skill in the art will appreciate, the spreading mechanism 16 is located at the rear of the machine 10 and includes a laterally extending trough (not shown), to which the paving material is delivered by the conveyors 18,20. A pair of augers (also not shown) are rotatably mounted within the trough for spreading the paving material on the roadway forwardly of a finishing screed 28. The screed 28 serves to press and level the paving material on the roadway.

A pair of swivel chairs 30,32 are mounted near the rear of the machine so that the operator may sit adjacent either side of the machine 10 during paving operations. It will be appreciated that paving operations, including steering of the machine 10, may be controlled from either of the chairs 30,32.

In greater detail, the hopper 16 includes a rear wall 34 adjacent the engine compartment 14 and having a pair of openings 36 and 38 along the bottom edge thereof leading to respective tunnels 22 and 24. Along the rear side of each of the openings 36 and 38 are corresponding gates 40 and 42 (FIG. 2) which may be raised and lowered by the operator for controlling the amount of paving material transferred by the conveyors 18 and 20. The side boundaries of the hopper 16 are defined by a pair of sidewalls 44 and 46, each including an upper substantially vertical portion 44*a* and 6*a*, an intermediate angled portion 44*b* and 46*b*, a slanted bottom portion 44*c* and 46*c*, a downturned portion 44*d* and 46*d* projecting slightly below conveyors 18 and 20, and a connecting brace 44*e* and 46*e* for connection with rear wall 34. The configuration of the sidewalls 44,46 serves to direct the gravitational flow of the paving material centrally toward the bottom of the hopper 16 formed by the conveyors 18,20. A fore-and-aft, triangular central divider 48 extends from the front of the hopper, through the engine compartment 14, and terminates at the trough. The divider 48 steers the gravitational flow of paving material to either conveyor 18 or 20.

Although the front of the hopper 16 is substantially open, a pair of rubber, side sealing members 50 and 52 extend inwardly from sidewalls 44 and 46, respectively, and taper downwardly therefrom to a relatively short front wall 54. The front wall 54 extends only between the downturned portions 44*d*,46*d* of the sidewalls 44,46 and angles downwardly and rearwardly toward the conveyors 18,20 (see FIGS. 3–6). A rubber central sealing member 56 is suspended between the sidewalls 44 and 46 by a cable 58. The sealing members 50,52 and 56 are preferably fastened to the machine by a plurality of mechanical fasteners, such as rivets or screws. As shown in FIG. 1, a pair of rubber bumper guards 60,62 are mounted to the front of the paving machine 10 for preventing damaging contact between the machine and the vehicle dumping paving material into the hopper 16.

As best shown in FIGS. 3 and 6, a dump truck 64 delivers a load of paving material P to the hopper 16, wherein the truck 64 has a tiltable bed 66 which contains the paving material P during transport. The bed 66 includes a swingable rear gate 68. During paving operations the truck 64 is reversed into connection with the machine 10, the gate 68 is released so that it may swing freely, and the bed 66 is tilted upwardly so that the paving material P dumps into the hopper 16. The truck 64 and paving machine 10 move synchronously along the roadway during paving operations, such that the truck 64 remains connected with the paving machine 10 and continues to drop material P therein, until the bed 66 is empty. The flexibility of the central sealing member 58 and side sealing members 50,52 accommodates for slight misalignment between the truck 64 and machine 10 and various truck bed sizes, while providing a seal between the truck bed 66 and hopper 16 for preventing material P from dropping out of the hopper 16 (see FIGS. 3–6).

The preferred paving material P is a hot mix asphalt which contains rock and gravel of various sizes. As previously described, during transport, the asphalt tends to segregate into pockets of coarse and fine material, one of such pockets being depicted in FIGS. 4–5 and denoted by P'. Of course, it is highly desirable to homogenize the paving material P before it is spread on the road surface.

In this respect, I have devised a weir assembly 70 for mixing the paving material P as it flows downwardly due to gravitation and is moved rearwardly by the conveyors 18,20. The weir assembly 70 includes a plurality of weir members 72 spaced above conveyors 18,20 and relative to one another along the path of movement of the paving material. The weir members 72 are composed of generally rectangular plates which span the conveyors 18,20 and are connected to the central divider 48 and downturned portions 44*d*,46*d* of corresponding sidewalls 44,46 by suitable means, such as welding or mechanical fasteners. The members 72 are positioned substantially vertically within the hopper 16, whereby each member 72 presents a forwardly facing upright surface 72*a* having a bottom edge 72*b*. The weir members 72 are also positioned generally transverse to the path of movement of the paving material. Furthermore, the forwardmost weir member (the leftmost weir member viewing FIGS. 3 and 6) is configured so that the upper edge thereof does not project above the apex of divider 48, while the upper edges of the remaining members project progressively higher than the apex of the divider 48 as the rear of the hopper 16 is approached. Although the remaining members may be configured such that their respective upper edges are vertically level (i.e., do not project above the apex of central divider 48), the preferred construction ensures that each weir member presents a sufficient upright surface 72*a* for diverting flow of the paving material and that each member can withstand the loads experienced during paving operations.

As best shown in FIGS. 3 and 6, the bottom edge 72*b* of each weir member 72 and the conveyors 18,20 cooperatively define a vertical passageway through which the paving material passes as it is moved by the conveyor. Preferably, the passageways have incrementally increasing heights along the path of movement of the paving material; that is to say, the spacing between the bottom edge 72b and conveyors 18,20 increases incrementally as the rear of the hopper 16 is approached. Although the incremental increase of each passageway may be varied as desired, it has been found that an increase of approximately 1.5 inches between adjacent passageways is most effective in homogenizing the paving material P. Particularly, the forwardmost weir member is preferably spaced approximately 3.0 inches from the conveyor, the adjacent, rearwardly spaced member is approximately 4.5 inches above the conveyors 18,20, and so on such that the rearwardmost weir member is spaced approximately 9.0 inches from the conveyors 18,20.

In use, the weir assembly 70 has proven very effective in minimizing segregation of the paving material P. Turning particularly to FIG. 5, the weir members 72 serve to divert movement of the paving material along the path and to limit the amount of paving material moved by the conveyor. That is, the pocket of segregated material P' flows downwardly and is eventually moved rearwardly by the conveyors 18,20, until it encounters a weir member 72, whereby the upright surface 72a blocks further rearward movement of the pocket P', while a limited amount of the segregated material is allowed to pass through the passageway. It will be appreciated that the conveyors 18,20 are limited to shearing material from the pocket P' disposed between the bottom edge 72b and the upper boundary of the material passing under the adjacent, forwardly spaced (leftwardly spaced viewing FIGS. 3 and 6) weir member 72. For example, the material passing through the passageway defined by the weir member adjacent the forwardmost member is limited generally to that material disposed between 3.0 inches and 4.5 inches above the conveyors 18,20. This relationship is best illustrated in FIG. 5 by the horizontal lines corresponding to the bottom edges 72b of each weir member 72, wherein the amount of material moving through each passageway is defined by the bottom edge 72b and the line spaced immediately therebelow. However, it will also be appreciated that the paving material moving through each passageway does not remain between its corresponding horizontal lines, but mixes with the paving material passing through the other passageways. Furthermore, while rearward movement the pocket of segregated material P' is checked by the weir member 72, the operating vibrations of the machine 10, along with the rearward urging by the conveyors 18,20, tumble and comminute the pocket P', as illustrated in FIG. 4.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention. For example, the weir members 72 may be angled forwardly so that the upright surface 72a serves more to divert paving material toward the conveyors 18,20, rather than block movement of the paving material along its path. Alternatively, the members 72 may be angled rearwardly so that the paving material moves primarily through the passageway, while a fraction of the material moves up and over the inclined surface of the weir member 72, as the material is moved rearwardly by the conveyors 18,20. The upright surface 72a may also be configured as a concave or convex face, rather than the flat face illustrated. It is also entirely within the ambit of the present invention to install the weir assembly 70 on various other paving machines, such as a machine having a single conveyor spanning the bottom of the hopper, rather than the pair of conveyors 18,20 illustrated.

The inventor hereby states his intent to rely on the Doctrine of Equivalents to determine and assess the reasonably fair scope of the present invention as pertains to any apparatus not materially departing from but outside the literal scope of the invention as set out in the following claims.

What is claimed is:

1. In an asphalt paving machine including spreading mechanism for distributing paving material to the roadway, a hopper, and a conveyor forming the bottom of the hopper for moving paving material along a path extending through the hopper and to the spreading mechanism, a device for mixing the paving material as it moves along the path comprising:

a plurality of stationary weir members mounted within the hopper and spaced above the conveyor, said weir members being spaced along the path of the paving material, each of said weir members presenting an upright surface having a bottom edge, said bottom edge and the conveyor defining a generally vertical passageway through which the paving material passes as it is moved by the conveyor, said passageways having incrementally increasing heights along the path of movement of the paving material.

2. The asphalt paving machine as set forth in claim 1, said heights increasing by about 1.5 inches sequentially along the path of movement of the paving material.

3. The asphalt paving machine as set forth in claim 1, said upright surfaces being substantially flat and vertical.

4. The asphalt paving machine as set forth in claim 3, said bottom edges being substantially parallel to the conveyor.

5. The asphalt paving machine as set forth in claim 4, said weir members being formed of rectangular plates extending transversely to the path of the paving material.

6. The asphalt paving machine as set forth in claim 5, said plates being substantially similar in size.

7. The asphalt paving machine as set forth in claim 6, said plates being composed of metal.

8. In an asphalt paving machine including spreading mechanism for distributing paving material to the roadway, a hopper, and a conveyor forming the bottom of the hopper for moving paving material along a path extending through the hopper and to the spreading mechanism, a device for mixing the paving material as it moves along the path comprising:

a plurality of stationary weir members mounted within the hopper and spaced above the conveyor, said weir members being spaced along the path of the paving material, each of said weir members presenting an upright surface having a bottom edge, said bottom edge and the conveyor defining a generally vertical passageway through which the paving material passes as it is moved by the conveyor, said bottom edge being substantially parallel to the conveyor, each of said weir members being formed of a rectangular plate extending transverse to the path of paving material.

9. The asphalt paving machine as set forth in claim 8, said plate spanning the conveyor.

* * * * *